United States Patent [19]

Bosse

[11] 4,273,162

[45] Jun. 16, 1981

[54] BRAKING APPARATUS FOR TAPE ROLLERS OF WEAVING SHUTTLES

[75] Inventor: Frank Bosse, Tecklenburg, Fed. Rep. of Germany

[73] Assignee: Windmöller & Hölscher, Lengerich, Fed. Rep. of Germany

[21] Appl. No.: 85,541

[22] Filed: Oct. 17, 1979

[30] Foreign Application Priority Data

Oct. 27, 1978 [DE] Fed. Rep. of Germany ..... 2846920

[51] Int. Cl.[3] ..... D03D 37/00

[52] U.S. Cl. ..... 139/13 A

[58] Field of Search ..... 139/13 R, 13 A, 196.1, 139/199, 200

[56] References Cited

U.S. PATENT DOCUMENTS 961,817 6/1910 Steere ..... 139/200

3,871,413 3/1975 Torii ..... 139/13 R

FOREIGN PATENT DOCUMENTS 1169881 11/1966 United Kingdom ..... 139/13 A

*Primary Examiner*—Henry Jaudon

*Attorney, Agent, or Firm*—Fleit & Jacobson

[57] ABSTRACT

A shuttle for a circular loom comprises trunnions supporting and turning together with a winding core of a tape package. One of the trunnions carries a brake disc co-operating with a brake shoe carried by a pivoted lever which is connected to a rocker shaft by a spring. An arm on the shaft is spring-biassed to rest on the tape unwound from the package. If the tape slackens or breaks, the arm and hence the shaft turn to pivot the lever and thereby apply more pressure between the brake shoe and rotating brake disc.

6 Claims, 2 Drawing Figures

BRAKING APPARATUS FOR TAPE ROLLERS OF WEAVING SHUTTLES

The invention relates to an apparatus for braking the tape roller clamped between rotatable seating means in a weaving shuttle of circular looms, comprising a rocker shaft which is mounted parallel to the tape roller axis in the body of the shuttle, on which a tape guide yoke is secured and which carries a radial lever engaged by a spring seeking to pivot the tape guide yoke against the force of the withdrawn tape, and comprising means which brake the tape roller and which become effective on pivoting of the tape guide yoke by the spring when the tape becomes slack or breaks.

The present invention is used for feeding weft, such as, thread, filament, and tape, from a roller carried by a weaving shuttle of a circular loom. For the purposes of convenience, the term "tape" will be used hereinafter to identify the fed material. Such use of the term "tape" is intended to facilitate the following description, and not to limit the fed material to only "tape". It will be appreciated that thread and filament can also be fed with the present invention.

In known apparatuses of this kind, brake discs are pushed onto both ends of the winding core of the tape roller, the outer annular wall areas of the discs serving as brake surfaces. Two plates serving as brake shoes co-operating with these brake surfaces are connected directly to the rocker shaft and lie against the brake surface or are free therefrom depending on the amount of rotation of the rocker shaft occasioned by the spring tension. In the known apparatus, there is the difficulty of placing and securing the brake discs precisely centrally on the winding core because faults will occur if the brake surfaces do not turn concentrically with the rotary axis and thereby cause unintentional release or application of the brake. Another disadvantage is that, when changing the bobbin, the brake discs must be replaced on the new bobbin and consequently all previous adjustment of the brake is lost.

A further disadvantage of the known braking apparatus resides in the fact that the plates used as brake shoes are relatively short and therefore stiff for constructional reasons and make substantially only point contact with the brake surface. The known braking apparatus therefore functions abruptly and with shocks not only when the brake is applied but also when it is released. Consequently, especially on starting the loom by inching it along during adjustment and for example after a tape breakage, undesirably high tape tensions occur through the abrupt braking and restarting from standstill.

It is therefore the problem of the present invention to provide a braking apparatus for tape rollers of weaving shuttles which gently brakes the tape rollers corresponding to the operating conditions that obtain and which therefore avoids shock loads.

According to the invention, this problem is solved in an apparatus of the aforementioned kind in that one of the seating means is provided with a disc which forcibly rotates with the tape roller and against which a brake shoe can be applied that is so connected to the rocker shaft by way of a second spring that, on pivoting of the tape guide yoke, it increases the braking force against the first spring which pivots against the tape tension. In the apparatus according to the invention, the brake shoe can also gently rest on the brake disc while the tape is being withdrawn from the tape roller without thereby detrimentally influencing proper running conditions. If the tape guide yoke is turned by slack in the tape tension or through a break in the tape, the second spring is stressed corresponding to the amount of rotation and increases the braking force corresponding to the position of the tape guide yoke. By suitable choice of the spring characteristics, any desired gentle braking behaviour can therefore be set.

The apparatus of the invention has the further advantage that the tape or thread rollers can be clamped between the seating means in a simple and rapid manner without the need for placing the brake discs thereon and centreing same.

According to an advantageous constructional embodiment of the invention, it is provided that the brake shoe is secured to one end of a two-armed lever which is pivotable about a shaft secured in the body and the other end of which is connected by way of the second spring, which is a tension spring, to a lever secured to the rocker shaft and permits the brake to be set independently of the sleeve and the bobbin. Desirably, the lever arm of the two-armed lever that carries the brake shoe is flanged near its end so that it engages the back of the disc and holds the brake shoe in abutment with the rear marginal portion of the disc.

The annular area of the disc on which the brake shoe slides may be provided with a brake lining. Further, the disc carrying the brake lining can be made in one piece with the one seating means which are in the form of a cone.

A favourable brake characteristic is achieved if the spring force of the second spring increases super-proportionally when stressed.

One example of the invention will now be described in more detail with reference to the drawing, wherein.

Figure 1:
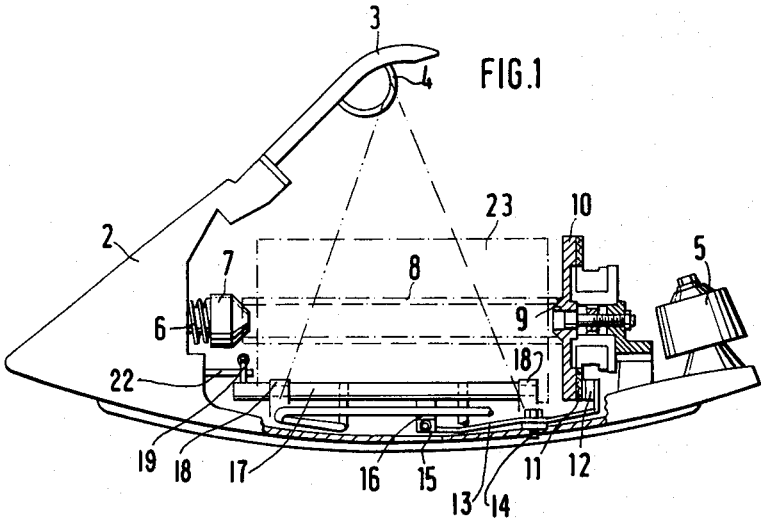
FIG. 1 is a part-sectional side elevation of the weaving shuttle.
Figure 2:
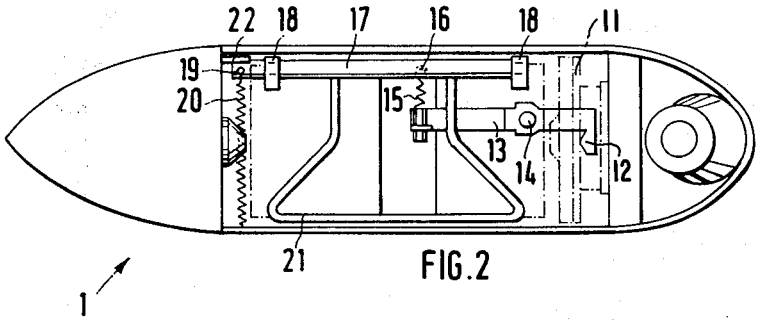
FIG. 2 is a plan view of the FIG. 1 shuttle.

The weaving shuttle 1 consists in known manner of a body 2 carrying a yoke 3 with a tape guide eye 4 as well as a rear guide roller 5. In the front portion of the body 2 there is a rotatable clamping cone 7 which is axially displaceable against the force of a spring 6 and which serves to locate one end of the winding core 8. The other end of the winding core 8 is held by a second cone 9 which is not axially displaceable, against which the winding core is pressed by the cone 7 and which is made in one piece with the brake disc 10. At the side opposite to the cone 9, the brake disc 10 has a brake lining 11 which is in operative relationship to a brake shoe 12. The brake shoe 12 is pressed to a larger or smaller extent against the brake lining 11 by means of a lever 13 which is pivotable about a pivot pin 14, so that the winding core 8 is braked by way of the cone 9. Preferably, the end of the lever 13 carrying the brake shoe 12 is flanged near its end so that it engages the back of the disc 10 and holds the brake shoe in abutment with the rear marginal portion of the disc. Pivoting of the lever 13 is effected by way of a tension spring 15 connected to the rocker shaft 17 by way of the lug 16. This rocker shaft 17 is rotatably mounted in two brackets 18, a pin 19 being secured at one end of the rocker shaft 17. The pin is engaged by a tension spring 20 which pulls the tensioning yoke 21 of the rocker shaft 17 towards the base of the shuttle 1. An abutment 22 prevents the tensioning yoke 21 from being swung upwardly against the force of the spring 20 to such an extent that it might press against the tape roller 23 and brake same. During operation, the tape is passed between the front portion of the tensioning yoke 21 and the base of the shuttle 1 and threaded through the eye 4. Depending on the tape tension, the tensioning yoke 21 is then lifted to a greater or less extent, whereby the rocker shaft 17, and with it the lug 16, are turned. The tension spring 15 secured to the lug 16 is thereby relieved so that the brake shoe 12 seated at one end of the lever 13 stressed by the tension spring 15 will only be gently pulled towards the brake disc 10. If, now, a tape breakage occurs, the tensioning yoke is pulled by the tension spring 20 towards the base of the shuttle. This causes the tension spring 15 to be stressed and to turn the lever 13 about the pivot pin 14 in such a way that the brake shoe 12 is pulled towards the brake lining 11 of the brake disc 10 and gently brake same, and with it the tape roller 23.

I claim:

1. Apparatus for braking a tape roller positioned in a weaving shuttle of a circular loom comprising:

a rocker shafter (17) mounted parallel to an axis of a tape roller positioned in a body of the shuttle;

guide yoke means (21) secured on the rocker shaft for guiding tape;

radially extending abutment means (10) carried by the rocker shaft for limiting movement thereof;

first spring means (20) engaging the rocker shaft for pivoting the guide yoke means against a force exerted by tape being withdrawn from the taper roller;

means for braking the tape roller effective on pivoting of the guide yoke means by the first spring means when the force exerted by the withdrawn tape is reduced by tape slackage or breakage;

a plurality of rotatable seating means in the weaving shuttle for clamping the tape roller, one of the seating means (9) having a disc (10) which forcibly rotates with the tape roller (23), the means for braking including a brake shoe (12) engageable with the disc (10), and second spring means (15) for connecting the brake shoe to the rocker shaft so that, on pivoting of the guide yoke means (21), the second spring means (15) increases the braking force against the first spring means (20) which pivots against the tape tension;

the means for braking further including a two-armed lever (13), and a shaft (14) carried by the shuttle for pivotally mounting the two-armed lever (13), the brake shoe (12) being secured to one end of a lever arm of the two-armed lever, the end of the other lever arm of the two-arm lever being connected by the second spring means (15) to the rocker shaft (17).

2. Apparatus according to claim 1, wherein the second spring means (15) is a tension spring.

3. Apparatus according to claim 1 or 2, characterised in that the lever arm of the two-armed lever (13) that carries the brake shoe (12) is flanged near its end so that it engages the back of the disc and holds the brake shoe (12) in abutment with the rear marginal portion of the disc.

4. Apparatus according to claim 1 or 2, characterised in that an annular area of the disc on which the brake shoe slides is provided with a brake lining (11).

5. Apparatus according to claim 1 or 2, characterised in that the disc (10) carries a brake lining (11) and is made in one piece with the one seating means (9), the disc (10) and one seating means (9) being in the form of a cone.

6. Apparatus according to claim 1 or 2, characterised in that the spring force of the second spring means (15) increases super-proportionally when stressed.

* * * * *